US008116658B2

(12) United States Patent
Amico et al.

(10) Patent No.: US 8,116,658 B2
(45) Date of Patent: Feb. 14, 2012

(54) MARKING ENGINE VIEWING SYSTEM

(75) Inventors: Mark S. Amico, Pittsford, NY (US); Michael R. Furst, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 934 days.

(21) Appl. No.: 12/125,233

(22) Filed: May 22, 2008

(65) Prior Publication Data

US 2009/0290902 A1 Nov. 26, 2009

(51) Int. Cl.
*G03G 15/00* (2006.01)

(52) U.S. Cl. ..... 399/107

(58) Field of Classification Search ..... 399/107, 399/361, 388, 397, 400, 405, 407, 411
See application file for complete search history.

(56) References Cited

U.S. PATENT DOCUMENTS

| | | | | |
|---|---|---|---|---|
| 3,632,201 | A * | 1/1972 | Granzow et al. | 399/1 |
| 3,724,940 | A * | 4/1973 | Koizumi | 399/192 |
| 3,966,194 | A * | 6/1976 | Abbe et al. | 271/186 |
| 4,733,270 | A * | 3/1988 | Nishikawa et al. | 399/155 |
| 5,208,612 | A * | 5/1993 | Obu et al. | 347/152 |
| 5,535,012 | A * | 7/1996 | Matsumoto et al. | 358/400 |
| 5,568,246 | A | 10/1996 | Keller et al. | |
| 5,570,172 | A | 10/1996 | Acquaviva | |
| 5,596,416 | A | 1/1997 | Barry et al. | |
| 5,995,721 | A | 11/1999 | Rourke et al. | |
| 6,973,286 | B2 | 12/2005 | Mandel et al. | |
| 7,188,929 | B2 | 3/2007 | Lofthus | |
| 2006/0033771 | A1 | 2/2006 | Lofthus | |
| 2006/0067756 | A1 | 3/2006 | Anderson et al. | |
| 2006/0114497 | A1 | 6/2006 | Anderson et al. | |

FOREIGN PATENT DOCUMENTS

| | | | |
|---|---|---|---|
| DE | 19925166 | A1 * | 9/2000 |
| JP | 60014252 | A * | 1/1985 |
| JP | 04184365 | A * | 7/1992 |
| JP | 06102715 | A * | 4/1994 |
| JP | 07234615 | A * | 9/1995 |
| JP | 08339102 | A * | 12/1996 |
| JP | 2007160854 | A * | 6/2007 |

OTHER PUBLICATIONS http://www.xerox.com/digital-printing/printers/, Product Brochures for: *Xerox Nuvera 100 Digital Printer for Digital Printing and Copying*.

* cited by examiner

*Primary Examiner* — Robert Beatty
(74) *Attorney, Agent, or Firm* — Fay Sharpe LLP

(57) ABSTRACT

A printing system includes a housing and a marking engine within the housing for marking print media conveyed on a paper path through the housing. A viewing system, such as a window in the housing, is positioned so as to enable an observer outside the housing to view a print job in progress.

17 Claims, 4 Drawing Sheets

MARKING ENGINE VIEWING SYSTEM

BACKGROUND

The exemplary embodiment relates to printing systems. It finds particular application in connection with a viewing system which enables viewing of a print job in progress, and will be described with particular reference thereto.

Electronic printing systems typically employ an input terminal which receives images in digital form and conversion electronics for converting the image to image signals or pixels. The printing system may include a scanner for scanning image-bearing documents or be connected to a computer network which supplies the digital images. The signals are stored and are read out successively to a marking engine for formation of the images and transfer of the images to a print medium, such as sheets of paper. In a typical xerographic (electrostatographic) marking engine, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to the print medium. The fusing of the toner onto paper is generally accomplished by applying heat to the toner with a heated roller and application of pressure. In multi-color printing, successive latent images corresponding to different colors are recorded on the photoconductive surface and developed with toner of a complementary color. Each toner is associated with a separate developer station and applied to the photoreceptor in sequence. The single color toner images are successively transferred to the copy paper to create a multi-layered toner image on the paper. The multi-layered toner image is then permanently affixed to the copy paper in the fusing process.

For large scale printers, the sheets which constitute a print job may travel along a lengthy paper path, passing through one or more marking engines as well as other components, such as paper feeders, inverters, stackers, bookbinders, and the like, before being finally output. Many pages of the print job may thus be in progress in the printing system before the first pages of a job or assembled document copy are output. If there is an error in the print job, such as incorrect image content, incorrect sheet orientation, or even an incorrect document selected for the print job, the operator may not be aware of the error until the first few copies of the job are output.

The operator has no ready way of viewing a print job in progress to determine if such visible errors are occurring. The marking engine is enclosed within a housing cabinet which is designed to shield the photoreceptor from all light, other than the light used in exposure of the images. Typically the system is configured such that, if a door to the cabinet is opened, the current print job in progress is stopped. Since the opening of the door can allow light to enter and have a deleterious effect on the pages being printed, some or all of the pages may need to be reprinted once the door is closed and the system returned to an operational state. Thus, an operator avoids opening the door to view the job in progress.

INCORPORATION BY REFERENCE

The following references, the disclosures of each being totally incorporated herein by reference, relate generally to what have been variously called "tandem engine" printers, "parallel" printers, or "cluster printing" (in which an electronic print job may be split up for distributed higher productivity printing by different printers, such as separate printing of the color and monochrome pages): U.S. Pat. Nos. 5,568,246, 5,570,172, 5,596,416, 5,995,721, 6,973,286, and 7,188,929; and U.S. Publication Nos. 2006/0033771, 2006/0067756, and 2006/0114497.

BRIEF DESCRIPTION

In accordance with one aspect of the exemplary embodiment, a printing system includes a housing and a marking engine, within the housing, for marking print media conveyed on a paper path through the housing. A viewing system is positioned so as to enable an observer outside the housing to view a print job that is in progress within the housing.

In accordance with another aspect of the exemplary embodiment, a method includes printing a print job, including conveying print media on a paper path through a marking module, applying a marking material to the print media within the marking module to form marked media, and providing a viewing window whereby an observer is able to view a print job in progress.

In accordance with another aspect of the exemplary embodiment, a viewing system in a printing system which includes a paper path defined by a plurality of modules is provided. The plurality of modules includes at least one marking module, each of the plurality of modules including a housing. The at least one marking module includes a light sensitive photoreceptor, within its housing, for applying a toner to print media conveyed on the paper path. The viewing system includes a light source, within the at least one marking module housing, which illuminates print media having a toner image formed thereon. A window in the housing is positioned to enable an observer to view print media that has been marked by the marking engine.

DETAILED DESCRIPTION

Aspects of the exemplary embodiment relate to a marking module with a viewing system and to a printing system including such a viewing system. The viewing system allows a print job in progress to be viewed, upstream of the output, so that visible errors in the printing can be detected. In one embodiment, the viewing system includes a viewing window formed in a housing of the marking module. In another embodiment, the viewing system includes an image capture device, such as a video camera, high speed still camera, or the like.

As used herein, a printing system can include any device for rendering an image on print media, such as a copier, laser printer, bookmaking machine, facsimile machine, or a multifunction machine. "Print media" can be a physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the image forming device and may include text, graphics, pictures, and the like. A "marking module" generally includes at least one marking engine for marking print media during the course of a print job. A "finisher" can be any post-printing accessory device, such as a tray or trays, sorter, mailbox, inserter, interposer, folder, stapler, stacker, hole puncher, bookbinder, collater, stitcher, binder, envelope stuffer, postage machine, or the like. The operation of applying images to print media, for example, graphics, text, photographs, etc., is generally referred to herein as printing or marking. A "document" is used herein to mean an electronic (e.g., digital) or physical (e.g., paper) recording of information. In its electronic form, a document may include image data, audio data, or video data. Image data may include text, graphics, or bitmaps.

Figure 1:
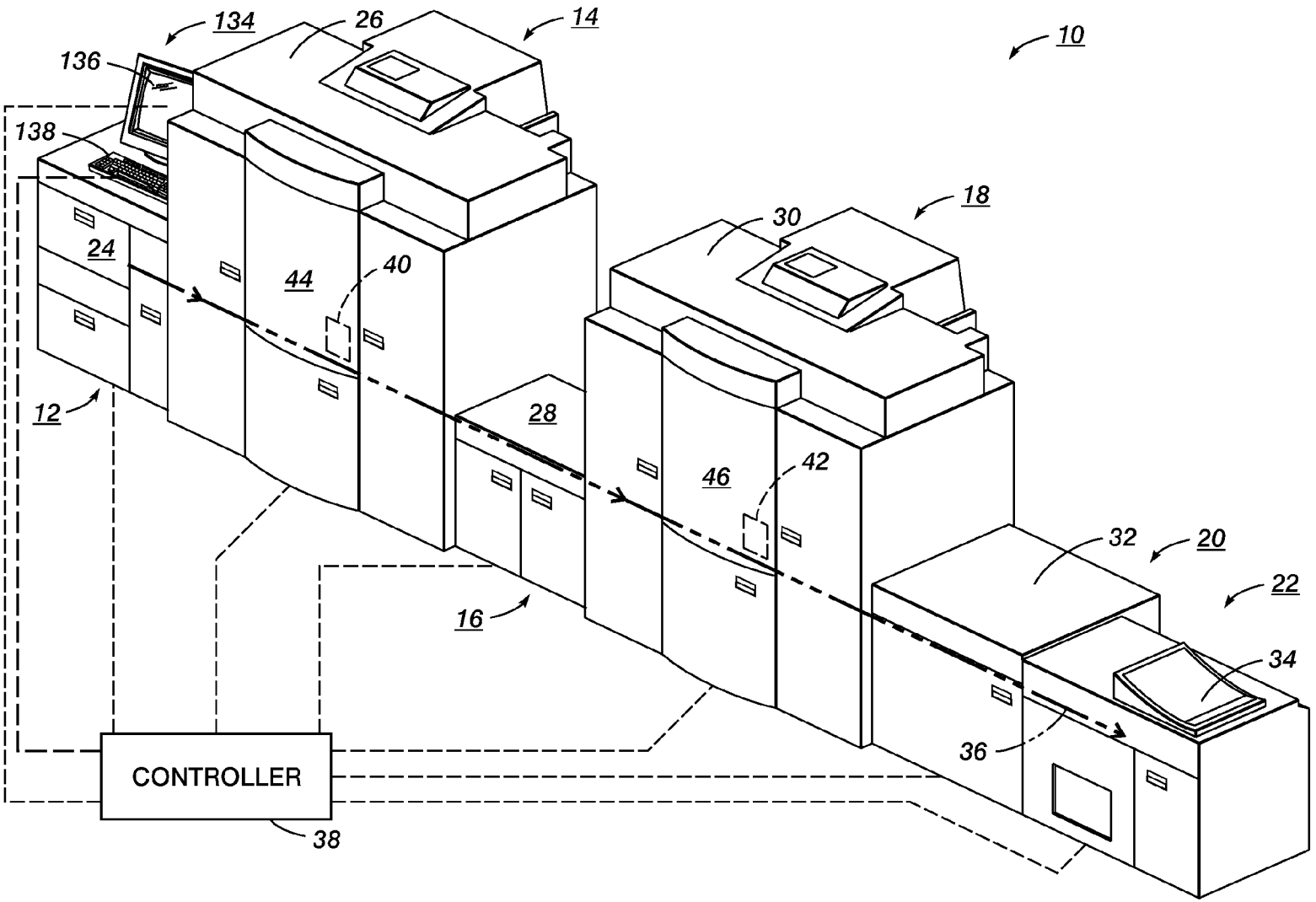
FIG. 1 is a perspective view of a printing system in accordance with one aspect of the exemplary embodiment.

With reference to FIG. 1, one embodiment of a modular printing system 10 is shown. The printing system 10 may be a printer, copier, or a multifunction device having printing and/or copying functions, optionally along with other capabilities such as faxing, emailing, bookbinding, and the like. The exemplary printing system 10 includes various modules 12, 14, 16, 18, 20, 22, each including a respective outer housing 24, 26, 28, 30, 32, 34, such as a cabinet having walls on all sides. Print media, such as paper, travels along a paper path 36 (illustrated in phantom) through the modules, generally in a downstream direction, as shown. Upstream paths (not shown) may additionally be provided. The print media may be in the form of sheets or a continuous web. Each module 12, 14, 16, 18, 20, 22 includes a portion of the paper path 36.

The modules 12, 14, 16, 18, 20, 22 can be of any type normally associated with an electrostatographic printing system, such as one or more paper feeder modules 12, one or more marking modules 14, 18 one or more interface modules 16, 20, and one or more finisher modules 22. The interface module(s) 16, 20 may include an inverter. The finisher module 22 or modules can include, for example, a stacker module, bookbinder module, stapler module, or combinations or multiples thereof, or the like, one or more of which can serve as output modules for a print job. Additionally, while the system 10 is shown as including individual modules for each of the components, each with a respective housing, it is also contemplated that two or more of the modules 12, 14, 16, 18, 20, 22 may be combined and share a housing.

The printing system 10 is used for printing, in which print media is fed from the feeder module 12 to one or more marking modules 14, 18, where it is marked with a marking material, such as toner, fused, and then output at the finisher module 22. A conveyor system (not shown) comprising drive rollers, air jets, or the like, conveys the print media through the printing system 10, from the feeder module 12 to the finisher module 22. The modules 12, 14, 16, 18, 20, 22 may all be under the control of a common control system 38, which receives an incoming print job and schedules printing of the job by the one or more marking modules. The control system 38 may be what is commonly known as the digital front end (DFE) of the printing system and include the software and hardware for identifying pages of the print job, converting them to a suitable format for printing by the marking modules, then distributing the pages appropriately among the marking modules.

The marking module 14 includes a viewing window 40 which is arranged for viewing a print job in progress. Where two or more marking engine modules 14, 18 are present in the system 10, each may be similarly configured with a respective window 40, 42. The exemplary window 40, 42 is positioned in a respective front panel 44, 46 of the housing 26, 30, so that an operator of the printing system 10 can look through the window 40 and see a portion of the paper path 36 and marking engine within the outer housing 26. In the following description, only one of the marking modules 14 will be described in further detail, with the understanding that other marking module(s) 20 may be similarly configured.

Figure 2:
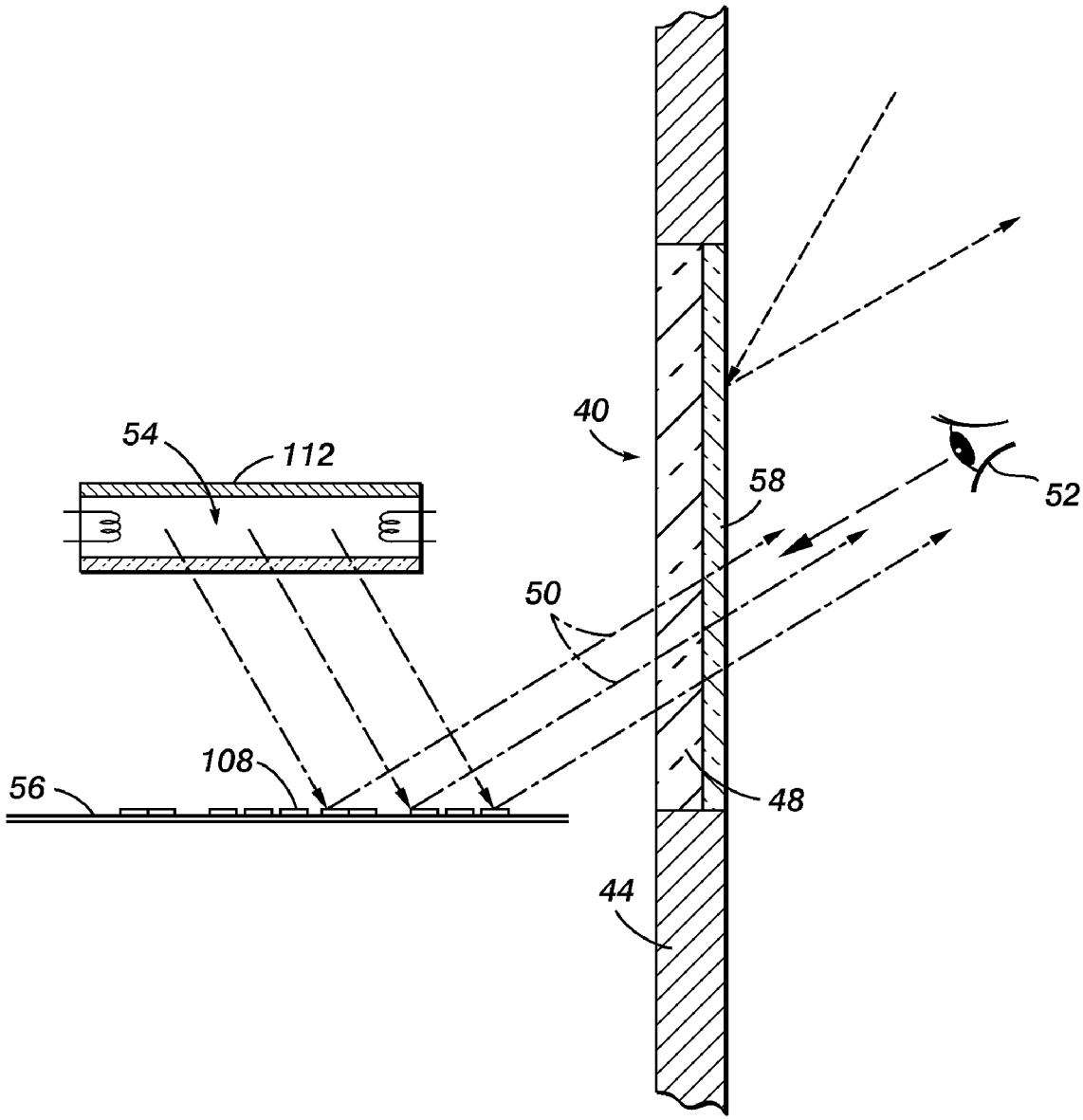
FIG. 2 is a side view of a portion of one of the marking modules of the printing system of FIG. 1, illustrating a window formed in the housing and a light source illuminating marked media within the housing.

As shown in FIG. 2, the window 40 may be formed from a layer or plate 48 of optically transmissive material which allows sufficient light 50 in the visible range of the spectrum to pass through to enable the operator 52 to view the print job through the window. For example, the window 40 or plate 48 may be formed from plastic (e.g., Plexiglass™), glass, or the like. In the illustrated embodiment, light from a light source 54 reflects off the printed media 56 and passes through the window 40. The window 40 may be wavelength selective, e.g., by incorporating a filter 58 for filtering out wavelengths in one or more regions of the electromagnetic spectrum. While the window of FIG. 2 is shown as including separate layers 48, 58, it is to be appreciated that a filtering medium may alternatively be incorporated into the layer 48. The filter 58 or filtering medium can reduce transmission of light into the housing 26, which could interfere with proper functioning of the marking engine. The window may polarize light, for example, by incorporating a polarizing filter (as for layer 58) to avoid light entering the housing 26 from outside.

In the exemplary embodiment, the light source 54 is located within the housing 26, although in other embodiments, the light source 54 may be located outside the housing 26 but positioned to illuminate the interior through a suitably positioned window, which may be the same as window 40 or a separate window.

The window 40 may be small in size, relative to the size of the outer housing 26, such as about 5-15 cm in height and 10-30 cm in width, e.g., about 10×20 cm.

The front panel 44, 46 may be in the form of a door which allows access to the interior of the respective housing 26, 30. Apart from the window 40, 42, the front panel may be formed of a substantially non-transmissive material (i.e., does not permit viewing of the housing interior), such as an opaque plastic, metal, or the like.

Figure 3:
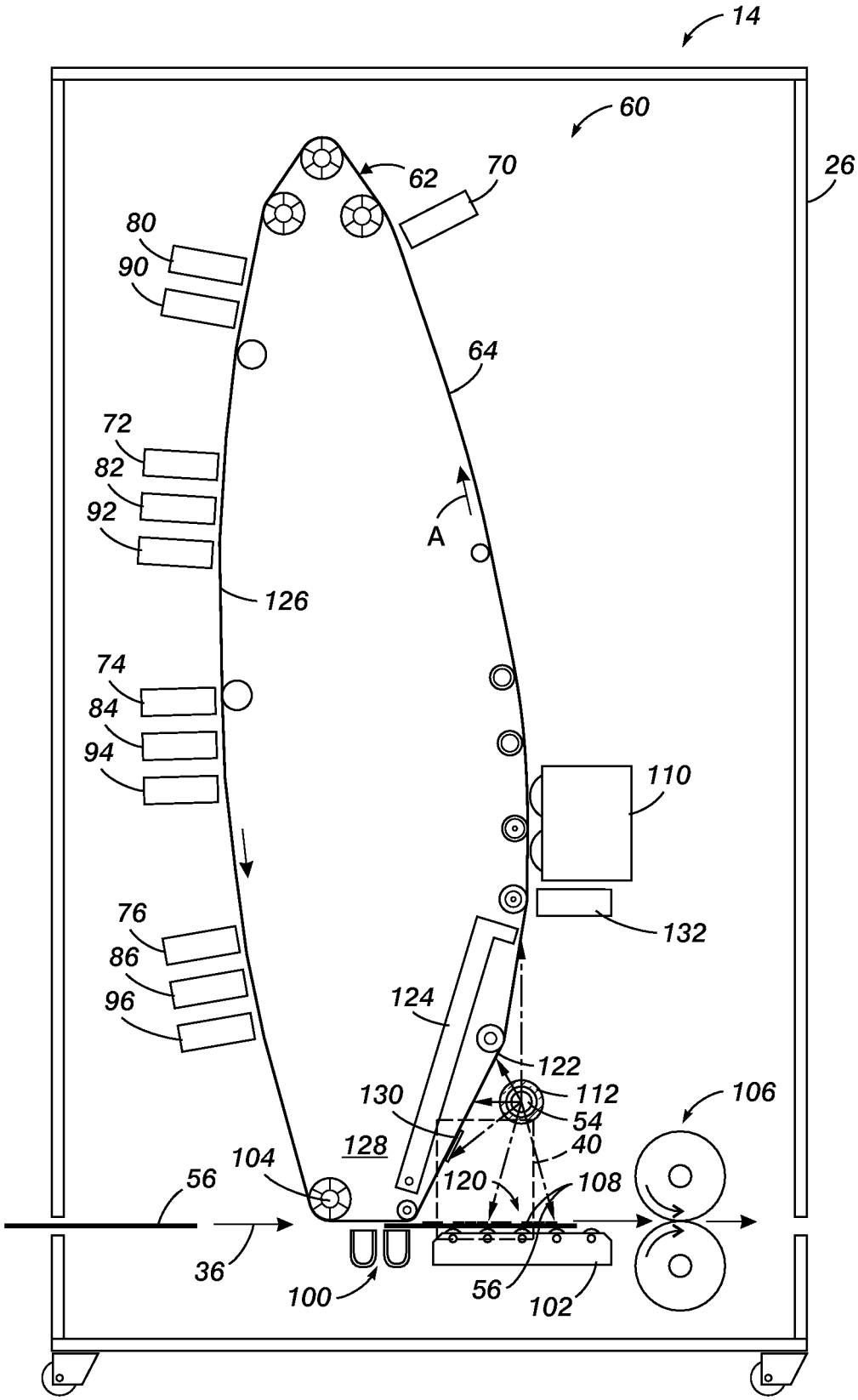
FIG. 3 is a schematic cross sectional view of one of the marking modules of the printing system of FIG. 1.

With reference to FIG. 3, marking module 14 includes an electrostatographic marking engine 60 for applying images to print media 56 as the print media passes through the marking module along the paper path 36. The marking engine 60 includes a charge retentive surface or imaging surface 62, such as a surface of a photoreceptor 64. The photoreceptor may be in the form of a continuous belt or drum. The exemplary photoreceptor 64 is in the form of a belt supported on rollers, and is driven in a counter clockwise direction as illustrated by arrow A. It is formed of a flexible material and may be at least partially permeable to light. At least one charging station is disposed adjacent the photoreceptor belt for charging the surface 62 of the photoreceptor 64. The charging station may include a corotron or dicorotron corona generating device. For a single color imaging device, a single charging station is used. In the exemplary embodiment, which is suited to process color imaging of four color separations, magenta, yellow, cyan, and black, each color has its own charging station 70, 72, 74, 76 respectively arranged at spaced locations around the belt.

Each color separation has a respective latent image forming unit 80, 82, 84, 86, which forms a latent image on the surface 62 of the photoreceptor belt. In the exemplary embodiment, the image forming units are laser raster output scanner (ROS) devices, which emit light in a narrow wavelength band, such as about 760 nm. A developing station 90, 92, 94, 96 is associated with each charging station for developing the latent image formed on the surface of the photoreceptor belt 64 by applying a toner to obtain a toner image. The toner is generally in the form of particles, although liquid toners are also contemplated. A transferring unit 100 transfers the toner image thus formed to the surface of a sheet of print media 56 passing along the paper path 36. The sheet is carried by a prefuser transport unit 102, located downstream of the image transfer point 104, to a fuser 106, which fuses the toner particles 108 (shown greatly enlarged for clarity) to the print media 56. A cleaning station 110, is positioned to clean residual toner from the photoreceptor 64 before the process is repeated.

The light source 54 may be a source of white light (emitting light in substantially all wavelengths in the visible range), such as a fluorescent lamp, incandescent lamp, light emitting diode (LED), metal halide lamp, or combinations or multiples thereof. Alternatively, the light source 54 is selected to emit light in a visible wavelength range which is outside the wavelength range emitted by the ROS 80, 82, 84, 86 and/or to which the photoreceptor 64 is particularly sensitive. For example if the photoreceptor 64 is most sensitive to light in the wavelength range of about 650-770 nm, the light source 54 emits light in a range of about 400-600 nm, e.g., below about 550 nm. In one embodiment, a filter 112 may be provided on or around the light source 54 to selectively filter out light in the range to which the photoreceptor is particularly sensitive. Filter 112 may be in the form of a coating or film, e.g., on an exterior surface of the lamp bulb.

The light source 54 may be mounted to part of the housing 26 and emits light when energized by an appropriate power source (not shown). In the exemplary embodiment, the light source 54 may remain on during printing of the job, or may be switched off once the operator has confirmed the job is proceeding satisfactorily. The light source 54, unlike the laser 80, 82, 84, 86 or other light source used in the exposure of the photoreceptor 64, thus remains continuously on (lit) and its light illuminates the same portion of the paper path for a relatively long period, e.g., at least for a plurality of revolutions of the photoreceptor 64, while several sheets of printed media 56 pass by. The light source 54 may also have a lower intensity than the laser 80, 82, 84, 86 and emit in a broader range of wavelengths.

In one embodiment, the light source has selectable modes of operation, such as two or more of: a) on all the time the marking engine is powered, b) on only when photoreceptor is rotating, c) on only when requested by the observer, Keeping the light off when not being used for observations may help to protect the photoreceptor from light leaks. The light source may be controllable from the main control or a separate control device As shown in FIG. 3, the light source 54 is positioned to illuminate a toner side 120 of the marked sheet 56. In the exemplary embodiment, the light source is located proximate the paper path 36, to illuminate the print media at a location which is downstream of the image transfer point 104, e.g., intermediate the image transfer point 104 and the fuser 106. The exemplary light source 54 is mounted above the paper path 36 to illuminate the imaged side of the sheet, e.g., it may be positioned intermediate an upwardly traveling portion 122 of photoreceptor belt and the sheet. The light source 54 may be mounted to a portion of the housing 28.

A shield 124, formed of an opaque material such as plastic or metal, is positioned to shield at least a portion 126 of the photoreceptor belt 64 from light emitted by the light source 54. In the exemplary embodiment, the shield 124 is located within the housing 26 and is interposed between the light source 54 and at least that the portion 126 of the belt which has been charged and/or carries undeveloped images thereon (i.e., exposed but not developed with toner), i.e. shields that portion 126 of the photoreceptor 64 which extends between the first charging station 70 and the last developer station 96. Since the exposure stations and developer stations are all located on the upstream side of the photoreceptor belt 64 in the exemplary embodiment, the light source 54 is conveniently positioned on the downstream side of the photoreceptor belt, with the shield 124 located in a cavity 128 interior of the belt 64, such that the shield is surrounded by the photoreceptor belt, although other locations are contemplated. This allows a portion 122 of the photoreceptor 64 to be illuminated by the light source 54, i.e., the portion 122 is located intermediate the light source 54 and the shield 124. The exemplary shield 124 is fixed in position, while the photoreceptor belt 64 moves around it. The exemplary shield is L-shaped, although other configurations such as a flat plate, or curved shape are also contemplated. In one embodiment, parts of the photoreceptor belt 64 may be already shielded by components of the marking engine 60 and thus additional shielding may be limited to a plate 124 positioned adjacent lower end of the belt, and extending generally vertically. In this embodiment, the horizontal top part of component 124 may be eliminated as its function is provided by marking engine components which may be spaced from the vertical plate. In other embodiments, the shield may be attached to the belt 64, e.g., as an inner layer of the belt. In the case of a photoreceptor 64 which is not light transmissive, such as a drum photoreceptor, formed from aluminum or the like, the photoreceptor itself may serve as the shield 124.

The window 40, shown in phantom in FIG. 3, is positioned to allow the viewer 52 (FIG. 2) to see the top 120 of the sheet 56 with the toner particles 108 thereon. Although the toner particles 108 are not fixed and may be still in toner layers on the sheet 56, the viewer can readily detect macro-errors in the printing of the print job in progress, such as incorrect image content, incorrect image orientation (e.g., an image which is oriented 180° to its desired orientation and thus may be upside down when the page is assembled as a book), or an incorrect document.

Additionally, the window 40 is positioned such that the adjacent portion 122 of the photoreceptor surface 62 is visible to the observer 52, through the window. In one embodiment, test patches 130 are imaged onto the photoreceptor belt 64 intermediate the toner images to be transferred to the print media. These imaged test patches 130, formed in a similar way to the toner images which are to be applied to the print media, remain on the belt 64 after it has passed the transfer point. A sensor 132 may be positioned to check the density or other properties of the test patches 130 as they pass by the sensor. An observer, looking through the window 40, can check that the test patches have been formed and are still on the belt as they reach the sensor 132. The window 40 is thus positioned to allow the observer to view a portion of the photoreceptor surface 62 that is located intermediate the transfer point 104 and the sensor 132.

As previously noted, the filter 58, where present in the window 40, filters out ambient light (light from outside the housing) which is in a wavelength range to which the photoreceptor 64 is sensitive.

As will be appreciated, the window 40 is not intended to serve as a substitute for calorimetric sensors, densitometers, image registration sensors, or the like which are capable of detecting errors on a micro-scale which may not be detected simply by human observation of the moving sheets 56 or moving color patches 130 through the window. The exemplary viewing system comprising the window and light source, however, provides a valuable tool for detecting macro-scale errors and, in cases where the marking engine operation is virtually silent, an indicator that the printing device is actually printing.

In a printing system with two marking modules 14, 18, one of which is used for marking a first side of the sheet and the other marking the other side, a viewing window 40, 42 can be provided in both housings 26, 30 so that the operator can check the toner images being formed on both sides of the sheet 56.

If an error is detected by the operator, e.g., in the printed pages 56 of the print job or test patches 130, the operator can take appropriate corrective action. For example, the operator may employ a user interface 134 (FIG. 1) located on or close to the printing system 10 to communicate the problem to the control system 38, so that the print job can be halted in a safe manner. The control system 38 controls the operation of the various modules 12, 14, 16, 18, 20, 22 during printing the print job. The user interface 134 can include one or more of a screen 136, and a user input device 138, such as a keyboard, keypad, cursor control device, touch screen, or the like.

Figure 4:
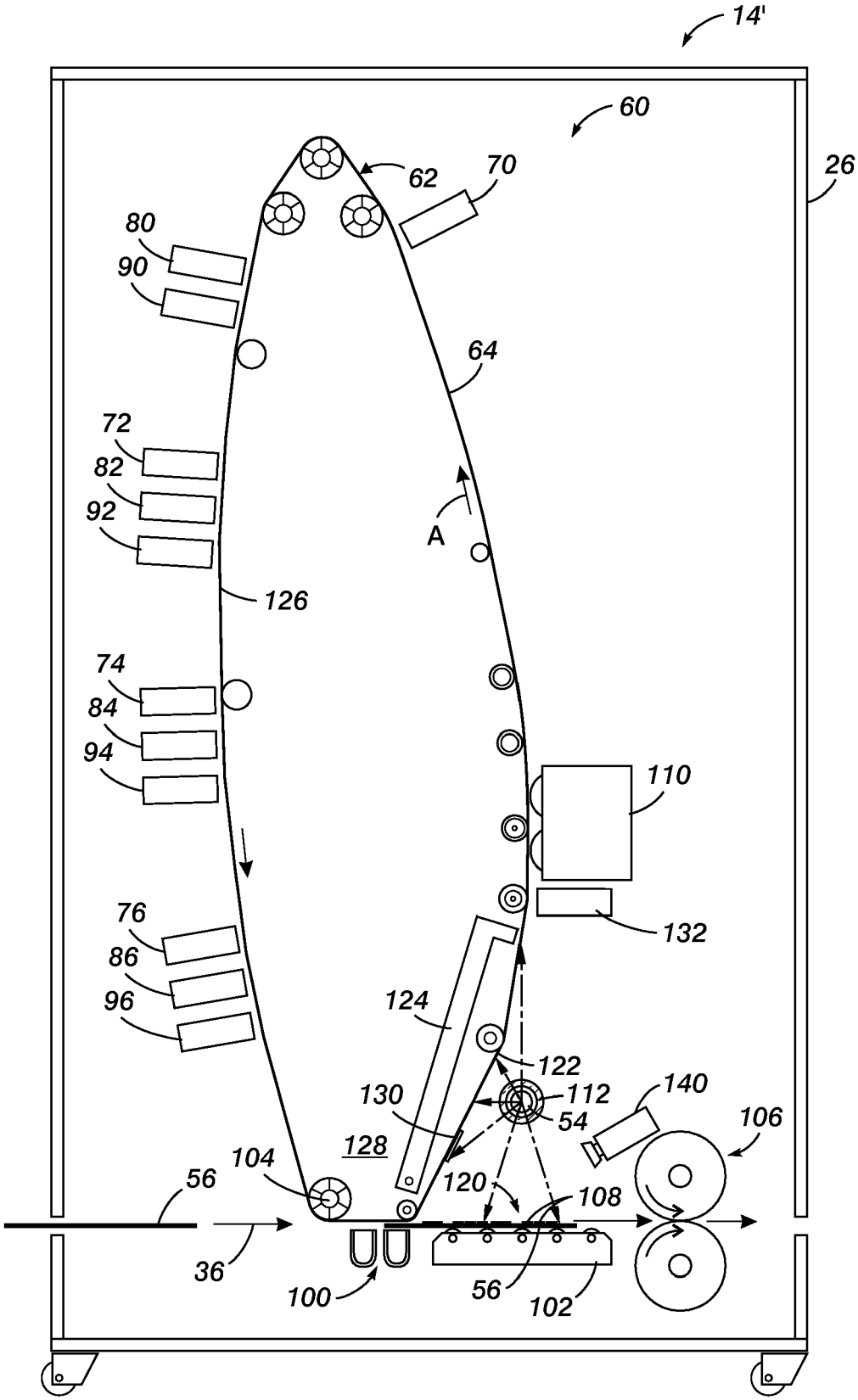
FIG. 4 is a schematic cross sectional view of an alternative embodiment of a marking module to be used in the system of claim 1.

With reference now to FIG. 4 another embodiment of a marking module 14' and visualization system is shown, where similar elements are accorded the same numbers and new elements are accorded new numbers. Marking module 14' may be analogous to a marking module 14, except as otherwise noted. In this embodiment, the visualization system includes an image capture device 140, such as a video camera, digital camera, or the like, which captures images of the sheet 56 and/or patches 130 during the progress of the print job. Window 40 can therefore be omitted. The images captured by the image capture device 140 can be displayed in contemporaneously, i.e., substantially in real time, to the observer 52, e.g., on the screen 136 of the user interface 134 or on a separate display device. The light source 54, in this embodiment, may be positioned to illuminate the sheet 56 and/or patches 130 from a suitable angle for reflected light to be captured by the image capture device 140. The image capture device 140 may be positioned within the housing 26, as shown, or located outside the housing adjacent a suitably positioned window analogous to window 40.

In various embodiments, the video camera may additionally be used for one or more of: local or remote diagnostics; job integrity monitoring by comparing captured images to scheduled images; and automated detection of gross errors in prints, such as significant deletions, smudges, belt hole defects, and the like.

Additional windows or video cameras may also be provided in other modules 12, 16, 20, 22.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a housing;

a marking engine housed within the housing for marking print media conveyed on a paper path through the housing; and a viewing system positioned so as to enable an observer outside the housing to view a print job that is in progress within the housing, wherein the viewing system comprises a window positioned so as to enable an observer outside the housing to view the print job in progress and the window selectively filters out ambient light in a wavelength range to which a photoreceptor of the marking engine is sensitive.

2. The printing system of claim 1, wherein the marking engine comprises an electrostatographic marking engine which marks the print media with toner to form marked media.

3. The printing system of claim 1, wherein the window is positioned to enable the observer to view print media within the housing that has been marked by the marking engine.

4. The printing system of claim 3, wherein the marking engine comprises an electrostatographic marking engine which marks the print media with toner to form marked media and wherein the window is positioned to view the marked media prior to fusing the toner.

5. The printing system of claim 1, further comprising a light source positioned to illuminate the print media viewed by the viewing system.

6. The printing system of claim 5, wherein the marking engine includes a photoreceptor which is sensitive to light and wherein at least a portion of the photoreceptor which has a latent image formed thereon is shielded from the light source.

7. The printing system of claim 6, wherein the photoreceptor is at least partially light transmissive.

8. The printing system of claim 5, further comprising a shield, which shields at least a portion of the photoreceptor which has a latent image formed thereon from light emitted by the light source.

9. The printing system of claim 6, wherein the light source includes a filter which selectively filters light in a wavelength range to which a photoreceptor of the marking engine is most sensitive.

10. The printing system of claim 1, wherein the window is formed of a light transmissive material which transmits light in the visible range.

11. The printing system of claim 1, wherein the marking module comprises first and second marking modules, each with a respective window.

12. The printing system of claim 1, further comprising a feeder module upstream of the marking module and a finishing module downstream of the marking module, the feeder module and finishing module both including a respective housing.

13. The printing system of claim 1, further comprising a user interface whereby the observer is able to request that the print job be halted when an error has been observed and a control system which halts the print job in progress in response to the request.

14. A printing system comprising:

a housing;

a marking engine housed within the housing for marking print media conveyed on a paper path through the housing;

a viewing system positioned so as to enable an observer outside the housing to view a print job that is in progress within the housing;

a light source positioned to illuminate the print media viewed by the viewing system; and a shield, which shields at least a portion of the photoreceptor which has a latent image formed thereon from light emitted by the light source, wherein the shield is surrounded by the photoreceptor.

15. A printing system comprising:

a housing;

a marking engine housed within the housing for marking print media conveyed on a paper path through the housing; and a viewing system positioned so as to enable an observer outside the housing to view a print job that is in progress within the housing, wherein the viewing system comprises a window positioned so as to enable an observer outside the housing to view the print job in progress and the window is positioned so that the observer can see a portion of a photoreceptor of the marking engine which is downstream of an image transfer point, such that when test patches are formed on the photoreceptor intermediate images to be applied to the print media, they are observable.

16. A printing system comprising:

a housing;

a marking engine housed within the housing for marking print media conveyed on a paper path through the housing; and a viewing system positioned so as to enable an observer outside the housing to view a print job that is in progress within the housing, wherein the viewing system comprises an image capture device positioned so as to enable an observer outside the housing to view the print job in progress and a display for displaying images captured by the image capture device.

17. A printing system comprising:

a paper path defined by a plurality of modules, the plurality of modules including at least one marking module, each of the plurality of modules including a housing, the at least one marking module including a light sensitive photoreceptor within its housing for applying a toner to print media conveyed on the paper path, a viewing system, the viewing system comprising:

a light source within the at least one marking module housing which illuminates print media having a toner image formed thereon; and a window in the housing positioned to enable an observer to view print media that has been marked by the marking engine, wherein the photoreceptor is at least partially light transmissive and wherein the system further comprises a shield which shields at least an exposed, yet to be developed, portion of the photoreceptor from the light source.

* * * * *